US009820622B2

(12) United States Patent
Van Der Kooi et al.

(10) Patent No.: US 9,820,622 B2
(45) Date of Patent: Nov. 21, 2017

(54) CYCLONE VACUUM CLEANER AND CYCLONE SEPARATION DEVICE

(71) Applicant: KONINKLIJKE PHILIPS N.V., Eindhoven (NL)

(72) Inventors: Johannes Tseard Van Der Kooi, Eindhoven (NL); Michael Van Den Bosch, Eindhoven (NL); Peter Dam, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 271 days.

(21) Appl. No.: 14/364,741

(22) PCT Filed: Dec. 17, 2012

(86) PCT No.: PCT/IB2012/057369
§ 371 (c)(1),
(2) Date: Jun. 12, 2014

(87) PCT Pub. No.: WO2013/093754
PCT Pub. Date: Jun. 27, 2013

(65) Prior Publication Data

US 2014/0373307 A1 Dec. 25, 2014

Related U.S. Application Data

(60) Provisional application No. 61/577,387, filed on Dec. 19, 2011.

(51) Int. Cl.
*A47L 9/16* (2006.01)
*A47L 9/00* (2006.01)
(Continued)

(52) U.S. Cl.
CPC ..... *A47L 9/1608* (2013.01); *A47L 9/0081* (2013.01); *A47L 9/1658* (2013.01); *B04C 5/14* (2013.01); *B04C 5/185* (2013.01)

(58) Field of Classification Search
CPC .... A47L 9/1683; A47L 9/1608; A47L 9/0081; B04C 5/185; B04C 5/14
See application file for complete search history.

(56) References Cited

U.S. PATENT DOCUMENTS 6,350,292 B1 2/2002 Lee
6,432,154 B2 8/2002 Oh
(Continued)

FOREIGN PATENT DOCUMENTS

CN 1548235 A 11/2004
DE 102008044184 A1 6/2009
(Continued)

*Primary Examiner* — Robert Scruggs

(57) ABSTRACT

The present invention relates to a cyclone separation device for separating particles from air and a cyclone vacuum cleaner (80). It has the objective to reduce noise without impairing the dirt separation performance. This is achieved an arrangement comprising a cyclone chamber (10), a dirt collecting chamber (50) arranged adjacent to the cyclone chamber (10) for collecting dirt particles separated from air, a dirt-duct (40) between the cyclone chamber (10) and the dirt collecting chamber (50) for allowing dirt particles to pass from the cyclone chamber (10) towards the dirt collecting chamber (50), and an air-guide (60) arranged adjacent to the dirt-duct (40) for reducing the momentum of the air in the dirt-duct (40).

14 Claims, 3 Drawing Sheets

(51) Int. Cl.
*B04C 5/14* (2006.01)
*B04C 5/185* (2006.01)

(56) References Cited

U.S. PATENT DOCUMENTS

| | | | | |
|---|---|---|---|---|
| 6,968,596 | B2 | 11/2005 | Oh | |
| 7,410,535 | B2 | 8/2008 | Song | |
| 7,996,957 | B2 | 8/2011 | Kah | |
| 2002/0011052 | A1* | 1/2002 | Oh | A47L 9/165 55/424 |
| 2002/0062531 | A1* | 5/2002 | Oh | A47L 9/104 15/353 |
| 2006/0037479 | A1 | 2/2006 | Song | |
| 2006/0117725 | A1 | 6/2006 | Oh | |

FOREIGN PATENT DOCUMENTS

| | | | |
|---|---|---|---|
| EP | 0966912 | A1 | 6/1999 |
| EP | 1647218 | A2 | 10/2005 |
| EP | 2324748 | A2 | 7/2009 |
| GB | 2417916 | A | 3/2006 |
| GB | 2418877 | A | 12/2006 |

* cited by examiner

CYCLONE VACUUM CLEANER AND CYCLONE SEPARATION DEVICE

This application is the U.S. National Phase application under 35 U.S.C. §371 of International Application No. PCT/IB2012/057369, filed on Dec. 17, 2012, which claims the benefit of U.S. Provisional Application No. 61/577,387 filed on Dec. 19, 2011. These applications are hereby incorporated by reference herein.

FIELD OF THE INVENTION

The present invention relates to a cyclone vacuum cleaner and a cyclone separation device for separating particles from air.

BACKGROUND OF THE INVENTION

In general, a vacuum cleaner comprises a suction nozzle to be moved along a surface to be cleaned, and a motor for generating a suction force which is used for removing particles, typically dust and dirt particles, from the surface and displacing these particles to the inside of the vacuum cleaner. A device is arranged inside the vacuum cleaner for separating the particles from the air. As a result of a separation process, the dust can be collected in a suitable space, and clean air can be blown out.

One possibility for separating dirt particles from air is using filters for performing the separating process. Dirt particles in this context refer to particles of arbitrary size, any kind of material including both solids and liquids. Another possibility is using suitable means for creating a cyclone movement (also commonly known as vortex movement) in the sucked-in mixture of air and particles, wherein the particles are displaced towards an outside circumference of the cyclone flow under the influence of centrifugal forces, where the particles can be collected. In practical situations, the cyclone flow is created in a cyclone chamber which is shaped like a hollow cylinder having a circular interior circumference, wherein the particles are discharged from the chamber through an opening in the side wall. This opening is a dirt-duct for allowing particles to pass from the cyclone chamber towards a dirt collecting chamber. Cleaned air leaves the cyclone chamber through an air discharging pipe at the center of said cyclone chamber. Such a cyclone separating apparatus and a vacuum cleaner having the same is known from U.S. Pat. No. 7,410,535.

A commonly known problem in the field of cyclone vacuum cleaners is noise caused by the whirling air stream in the aforementioned air discharging pipe. As the air stream performs a rotational movement in the cyclone chamber about the central axis of the cylindrical cyclone chamber, the fluid maintains this rotational movement and leaves the cyclone chamber through the discharging pipe in a spiral rather than a linear stream in direction of the central axis of the air discharging pipe.

U.S. Pat. No. 6,432,154 teaches the use of a noise reducing rib formed in an air discharging pipe as a solution to the problem. The noise reducing rib is protruded on an inner wall of the air discharging pipe towards a center of the air discharging pipe and comprises a curve portion and a straight portion. This element inhibits a rotational flow about the central axis of the air discharging pipe and rather guides the air stream in the discharging pipe into a liner stream along the central axis of the air discharging pipe.

SUMMARY OF THE INVENTION

It is a first object of the present invention to eliminate or at least reduce a further noise source in cyclone vacuum cleaners and cyclone separation devices. It is a second object of the present invention to maintain the dirt separation performance.

In a first aspect of the present invention a vacuum cleaner is presented that comprises a cyclone chamber, a dirt collecting chamber arranged adjacent to the cyclone chamber for collecting dirt particles separated from air, a dirt-duct between the cyclone chamber and the dirt collecting chamber for allowing dirt particles to pass from the cyclone chamber towards the dirt collecting chamber, and an air-guide arranged adjacent to the dirt-duct for reducing the momentum of the air in the dirt-duct.

In a further aspect of the present invention a cyclone separation device is presented that comprises a cyclone chamber, a dirt-duct for allowing dirt particles to exit the cyclone chamber, and an air-guide adjacent to the dirt-outlet for reducing the momentum of air in the dirt-duct.

Preferred embodiments of the invention are defined in the dependent claims. It shall be understood that the claimed cyclone separation device has similar and/or identical preferred embodiments as the claimed vacuum cleaner and as defined in the dependent claims.

There is no constant strong stream of air from the cyclone chamber through the dirt-duct towards the dirt collecting chamber, as it would be the case for the air discharging pipe. The circular or spiral air stream in the cyclone chamber passes by the opening in the side wall of the cyclone chamber that constitutes the dirt-duct between the cyclone chamber and the dirt collecting chamber. Passing by this opening may cause disturbances in form of vortices in the air stream of the cyclone. This causes one major problem in a vacuum cleaner or cyclone separation device.

Vortices in the dirt-duct cause pressure variations which in turn, for certain volumes of the dirt collecting chamber together with the shape of the dirt duct, cause a tonal noise. This effect is known as Helmholtz resonance. The dirt collecting chamber represents the resonant volume of a Helmholtz resonator, whereas the dirt-duct is the port of the Helmholtz resonator (also referred to as neck of the Helmholtz resonator). As a practical example, Helmholtz resonance is well known from generating sounds when blowing over a bottle, such as an empty bottle. The frequency changes depending on the resonator volume. As the volume in the dirt collecting chamber changes with increasing amount of dirt inside, it is neither practical nor cost-effective to introduce a volume varying element for influencing the tonal noise.

Again referring to the practical example, there is a tonal noise when blowing over an empty bottle. However there is no such noise, when blowing over an empty glass that has the same volume as the bottle but a larger diameter opening. Hence, the opening area towards the resonant volume also affects this resonance. In order to reduce tonal noises from Helmholtz resonance the size of the opening of the dirt-duct may simply be increased. However there is a trade-off between noise reduction and cleaning performance when changing the size of the opening of the dirt-duct. In order to maintain a high dirt separation performance, the opening may not be chosen arbitrarily large or arbitrarily small, because of negative impact on the cyclonic air stream in the cyclone chamber and the desired separation function.

The present invention effectively solves the aforementioned conflict. The air-guide according to the invention increases the area of the neck and therefore reduces the momentum of the air in the dirt-duct. This is achieved as the air-guide increases an effective opening area relevant for Helmholtz resonance without increasing actual size of the dirt-duct opening. In consequence, the oscillatory momentum of the air inside the dirt-duct is reduced. A higher momentum, because of a higher velocity of the oscillating air volume in the dirt duct causes higher pressure fluctuations, thus a higher amplitude of the oscillation which produces louder noise.

In a different aspect of the invention, the air-guide reduces vortices caused by the dust-duct.

In one embodiment of the invention, the air-guide protrudes into the cyclone chamber. This allows the air-guide to be integrally formed as a part of the cyclone chamber.

Preferably said air-guide is arranged at a dirt-duct ridge in downstream direction of a spiral air stream in the cyclone chamber. This has advantages over placing the air-guide in up-stream direction which may deteriorate particle separation performance by obscuring the path towards the dirt-duct.

Advantageously the length of the air-guide in direction of a central axis of the cyclone chamber, is larger or at least equal to the length of the dirt-duct in direction of a central axis of the cyclone chamber. This ensures that the beneficial effect of the air-guide can be exploited over the entire length of the dirt-duct in direction of a central axis of the cyclone chamber. Said length is in the range from 10 to 80 mm, in particular from 25 to 55 mm, preferably 40 mm.

With respect to possible shapes of said air-guide it is beneficial that the surface of the air-guide facing the center of the cyclone chamber has a curvature opposite to the curvature of the cyclone chamber. A preferred radius of curvature of the air guide is in the range from 15 to 70 mm, in particular from 20 to 40 mm, preferably 30 mm.

The air-guide may be implemented as a separate element, however it is beneficial to integrate the air-guide into the wall of the cyclone chamber for cost effective manufacturing. This also holds true for a combination of dirt-duct and the air-guide which may be integrally formed as one piece.

Furthermore an embodiment of the air-guide may have rounded edges, so as to prevent dirt, in particular fibers and hair, from being caught at edges and to also prevent injuries when handling the device. It is advantageous that surfaces of the air-guide are closed towards the wall of the cyclone chamber or towards the dirt-duct. This holds especially true for any gaps or openings that are exposed to the cyclonic air stream with impinging dirt particles.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
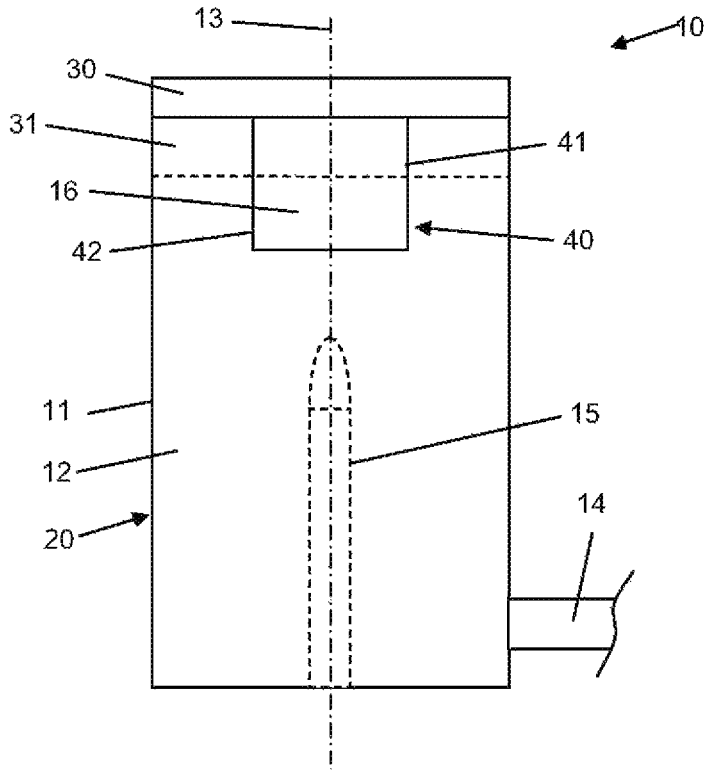
Fig. 1 PRIOR ART
FIG. 1 shows a first side view of a cyclone chamber according to prior art.
Figure 2:
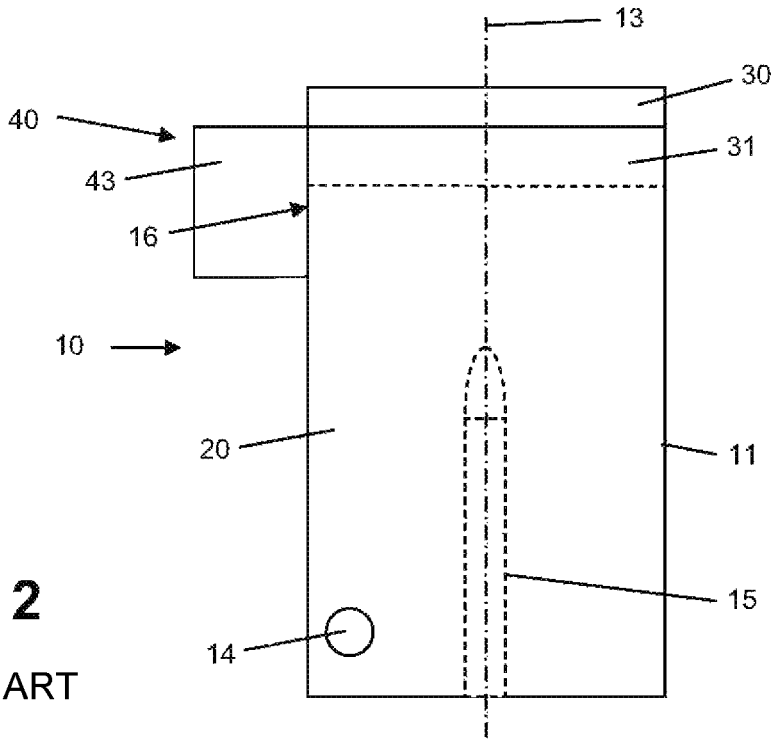
Fig. 2 PRIOR ART
FIG. 2 shows a second side view of a cyclone chamber according to prior art, FIG. 3 schematically shows a top view of the cyclone separation device according to prior art, FIG. 4 schematically shows a top view of the cyclone separation device according to the invention.

FIGS. 1 and 2 show a cyclone chamber 10 of a cyclone separating device according to prior art. The device serves for separating particles from air, and is intended to be used in a vacuum cleaner, particularly a so-called bagless vacuum cleaner, in which the separation process takes place by letting a sucked-in mixture of air and dirt particles perform a rotational vortex or cyclone movement, wherein the dirt particles can be collected at the outside of the cyclone. Air as the medium transporting the dirt particles rotates so fast that the air looses grip of the dust. Particles are forced away from the center by centrifugal force. Dirt separation occurs, when the centrifugal force is stronger than the component of the drag force of air which is pointing towards the center of the separator where the air is sucked out. Typical particles include plant pollen, human and animal hair, textile fibers, paper fibers, outdoor soil, water droplets, mud and human skin cells, in general all kinds of dirt, dust and liquid particles. All these particles are commonly referred to as dirt or dirt particles. Such a vacuum cleaner is a well-known device, and will therefore not be further elucidated here.

In general, the cyclone chamber 10 is shaped like a hollow cylinder having a circular interior circumference. Hence, a wall 11 of the cyclone chamber 10 has a curved interior surface 12. In FIGS. 1 and 2, a longitudinal axis of the cylinder shape, the central axis of the cyclone chamber, is indicated by means of a dash and dot line 13.

The cyclone chamber 10 has an inlet 14 for letting in a mixture of air and particles, which has a tangential arrangement with respect to the cylinder shape, so that a cyclone movement can be created in the mixture on its way further downstream in the cyclone chamber 10. Furthermore, the cyclone chamber 10 has an air outlet 15 for letting out clean air. In the shown example, the air outlet is realized at a central position in the cyclone chamber 10. Naturally, the air outlet 15 has at least one hole (not shown) for discharging the air from the cyclone chamber 10.

During operation of the vacuum cleaner or cyclone separation device, of which the cyclone chamber 10 is part, a mixture of air and particles is drawn into the cyclone chamber 10, through the inlet 14. The required pressure can be applied as commonly known from vacuum cleaners for example, by operating a motor (not shown) to generate a suction force. The mixture flows along the curved interior surface 12 of the wall 11 of the cyclone chamber 10, and is made to perform a cyclone movement rotating about the central axis 13 of the cyclone chamber 10. On the basis of the fact that there is a cyclone flow, the particles are separated from air, since the particles are separated from air by centrifugal force. In particular, the particles are forced to move away from the central axis 13 of the cyclone chamber 10, until they reach the interior surface 12 of the wall 11 of the cyclone chamber 10.

Advantageously, the cyclone chamber 10 comprises two pieces 20, 30, as is the case in the shown example, namely a basic piece 20 and a lid 30, wherein the lid 30 serves for closing the basic piece 20 at the side where the particle discharge opening 16 is located. The lid 30 has an insert portion 31 which is intended to be positioned inside the basic piece 20, which insert portion 31 has a circular circumference, and a diameter which is such that the insert portion 31 snugly fits into the basic portion 20. It is possible to use suitable means such as a sealing ring (not shown) between the lid 30 and the basic portion 20 for preventing air to enter into the under-pressure volume of the cyclone chamber 10 at the side of the lid 30. The lid 30 is only shown in FIGS. 1 and 2, wherein the insert portion 31 is indicated by means of dashed lines.

For the purpose of letting out the particles from the cyclone chamber 10, a particle discharge opening 16 is arranged in the wall 11 of the cyclone chamber 10. In the shown example, the particle discharge opening 16 is arranged at a position which is relatively far from the inlet 14, such as to ensure that there is sufficient length for the separation process to take place in a proper and complete manner.

It follows from the foregoing that during operation, air and particles are made to swirl inside the cyclone chamber 10, wherein the particles are forced to move outwardly, and wherein clean air is obtained at a more central position. The particles are discharged from the cyclone chamber 10 through the particle discharge opening 16, while the clean air is discharged through the air outlet 15.

The particle discharge opening 16 opens towards a dirt-duct 40 for guiding particles of dirt away from the cyclone chamber 10. In the shown example, the particle discharge opening 16 and dirt-duct 40 have a rectangular circumference, as seen in a radial direction with respect to the cylinder shape of the cyclone chamber 10. With respect to the direction of the cyclonic air stream 70 in the cyclone chamber 10, the particle discharge opening 16 towards the dirt-duct 40 has a first exit ridge 41 in upstream direction of the cyclonic air stream 70 and a last exit ridge 42 in downstream direction of the cyclonic air stream 70.

The dirt-duct 40 can be built as a separate part or integrally formed with the basic piece 20 of the cyclone chamber 10. Similar to the cyclone chamber 10, the dirt-duct 40 may consist of two parts, one of which is preferably formed with the basic piece 20 of the cyclone chamber 10 and one integrally formed with the lid 30.

FIGS. 3 to 6 illustrate the application of a dirt collecting chamber 50 besides the cyclone chamber 10 for receiving the dirt particles from the cyclone chamber 10 passing through the dirt-duct and collecting these particles. In the shown example, the cyclone chamber 10 is positioned adjacent to this particle collecting chamber 50, but that does not alter the fact that another mutual positioning of the chambers 10 and 50 is possible, as long as there can be a transfer of particles from the cyclone chamber 10 to the particle collecting chamber 50 through the dirt-duct 40.

Figure 3:
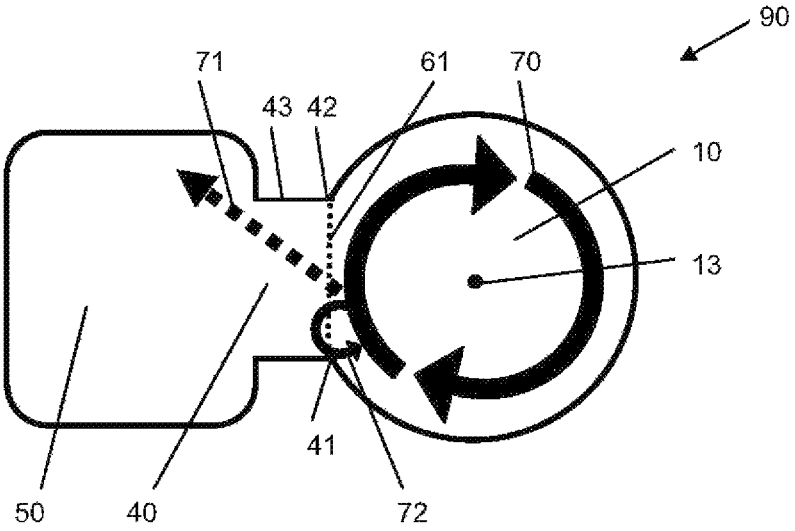
Fig. 3 PRIOR ART
Figure 4:
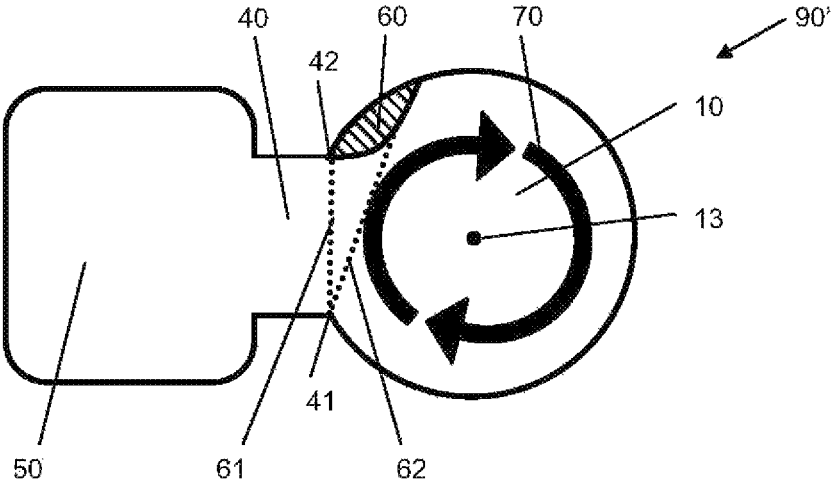

FIGS. 3 and 4 schematically show a top view of a cyclone chamber 10, a dirt collecting chamber 50 arranged adjacent to the cyclone chamber 10 for collecting particles separated from air and a dirt-duct 40 between the cyclone chamber 10 and the dirt collecting chamber 50 for allowing dirt particles to pass form the cyclone chamber 10 towards the dirt collecting chamber 50.

FIG. 3 schematically shows a top view of the cyclone separation device according to prior art, the cyclonic stream 70 of air and particles rotates about a central axis 13 of the cyclone chamber 10. The cyclonic stream 70 first passes by the first exit ridge 41 of the dirt-duct 40 and then the last exit ridge 42. A stream of dirt particles 71 passing from the cyclone chamber 10 through the dirt-duct 40 towards the dirt collecting chamber is shown in a simplified manner so as to illustrate the principle of a cyclone separation device 90. It shall be clarified that a dirt particle leaving the cyclone chamber 10 in general travels along the sidewall 11 of said cyclone chamber 10, before leaving the same on a tangential path due to centrifugal force. Depending on the geometry of the dirt-duct 40, a dirt particle may not reach the dirt collecting chamber 50 on one single straight path 71 as sketched, but strike at least one sidewall 43 of the dirt-duct 40 before passing on to the dirt collecting chamber 50.

A state-of-the-art cyclone separation device 90 for use in a cyclone vacuum cleaner is illustrated in FIG. 3 that exhibits vortices 72 at the first exit ridge 41 between the cyclone chamber 10 and the dirt-duct 40. Vortices 72 may cause little pressure variations that set the air in the dirt-duct 40 into movement. As the pressure increases, the air mass moves towards the dirt collecting chamber 50 to equalize pressure. This flow stops once the pressure in the dirt collecting chamber 50 is equal to the pressure in the cyclone chamber 10. If now the pressure in the cyclone chamber 10 decreases, air flows back from the dirt collecting chamber 50 through the dirt-duct 40 towards the cyclone chamber 10. A repetitive stream back and forth initiates Helmholtz resonance with the dirt collecting chamber 50 being the resonant volume and an entry area defined by the cross section 61 of the dirt-duct 40. The cross section 61 lies in the same plane as the particle discharge opening 16 in the side wall 11 of the cyclone chamber 10. An oscillatory movement of the air mass causes tonal noise. Momentum is generally defined as mass times velocity. The higher the momentum of the substantially constant air mass in the dirt-duct 40, the higher its velocity. A higher velocity at a constant frequency causes a higher amplitude of the oscillatory movement and thereby a louder tonal noise.

FIG. 4 shows an embodiment of a cyclone separation device 90' according to the present invention. In addition to the previously mentioned structural elements, an air-guide 60 protrudes into the cyclone chamber 10. The air-guide 60 is arranged at the exit ridge 42 in downstream direction of a cyclonic stream 70 in the cyclone chamber 10. The air-guide 60 converts the sharp exit ridge 42 into a blunt or curved transition from the cyclone chamber 10 to the dirt-duct 40, thereby avoiding disturbances to the cyclonic stream 70. Moreover the air-guide 60 according to the invention alters the Helmholtz resonator formed by the dirt collecting chamber 50 and the dirt-duct 40. The area of the neck of the Helmholtz resonator is no longer defined by the particle discharge opening 16 in the side wall 11 of the cyclone chamber 10 but is now formed between the first exit ridge 42 and a point on the air-guide 60. The area of this effective cross section 62 between the first exit ridge 41 and air-guide 60 is larger than the previous area of the cross section between the first exit ridge and the second exit ridge. In consequence a moving air mass brought to oscillation by Helmholtz resonance now distributes over a larger area 62. When a fixed stream of mass is distributed over a larger area in the neck of the Helmholtz resonator, the velocity of said stream of mass reduces. Thereby the amplitude of the oscillatory movement reduces, which in turn results in the desired noise reduction.

Figure 5:
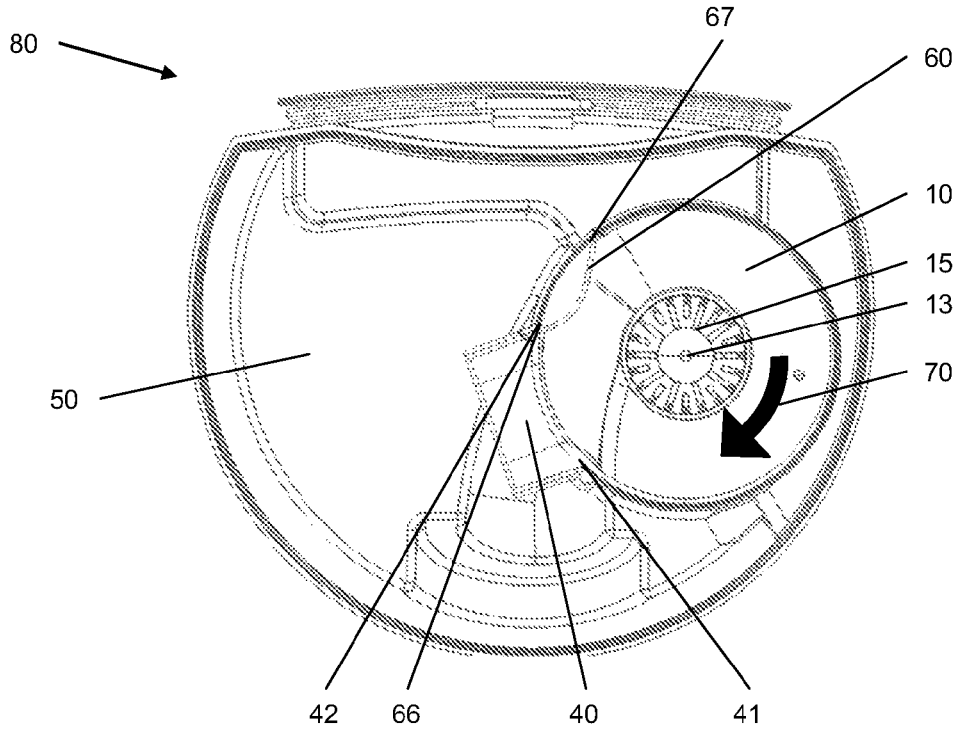
FIG. 5 shows a top view of a vacuum cleaner according to the present invention.
Figure 6:
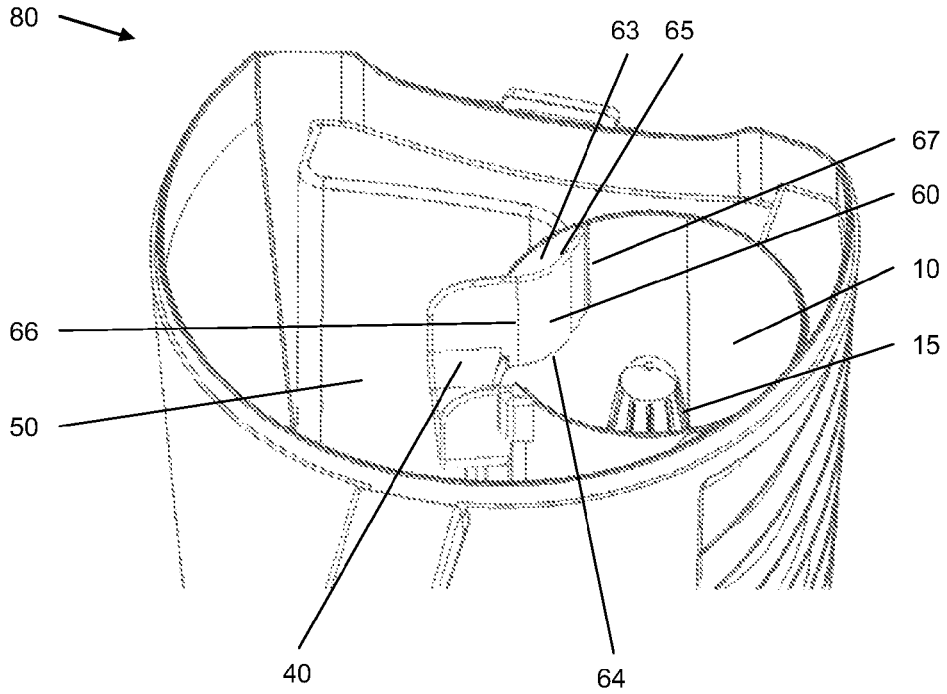
FIG. 6 shows a perspective view of a vacuum cleaner e according to the present invention.

FIGS. 5 and 6 exemplarily show a section of the body of a cyclone vacuum cleaner 80 according to the present invention in top view and perspective view. A vacuum cleaner comprising suction brush, pipe, handle, hose, cord, wheels is commonly known. The body of the cyclone vacuum cleaner 80 comprises the cyclone chamber 10, a dirt collecting chamber 50 arranged adjacent to the cyclone chamber 10 for collecting dirt particles separated from air, a dirt-duct 40 between the cyclone chamber 10 and the dirt collecting chamber 50 for allowing dirt particles to pass from the cyclone chamber 10 towards the dirt collecting chamber 50, and an air-guide 60 arranged adjacent to the dirt-duct 40 for reducing the momentum of the air in the dirt duct 40 The air-guide 60 stretches from the exit ridge 42 towards the interior of the cyclone chamber 10 and curves back towards the cyclone chamber wall 11 where it reaches the cyclone chamber wall 11 further downstream in direction of the cyclonic stream 70. The cyclonic stream 70 in this example is oriented clockwise. In another embodiment a cyclonic stream may rotate counterclockwise and hence the air-guide 60 may be integrated at a different location but again preferably in downstream direction.

The air-guide 60 preferably is a rounded shape. In this example, the surface of the air-guide 65 facing the interior of the cyclone chamber 10 has a curvature opposite to the curvature of the side wall 11 of the cyclone chamber 10, i.e. while the curvature of the cyclone chamber wall 11 can be seen as a right curve, the air-guide surface 65 may be seen as a left curve. The radius of curvature of the air guide is in the range from 15 to 70 mm, in particular from 20 to 40 mm, preferably 30 mm.

It should be noted that the curvature of the air-guide may change in sign so as to avoid a corner at the rear end 67 of the air-guide 60 but seamlessly integrate into the cyclone chamber wall 11. Exemplarily, the front side 66 of the air-guide 60 facing towards the last exit 42 of the dirt-duct 40 may form a smooth transition from the possibly straight side wall 43 dirt-duct 40 before bending over towards the cyclone chamber wall 11. One way of ensuring a smooth transition is integrally forming any combination of cyclone chamber 10, dirt-duct 40, dirt collecting chamber and air-guide 60 or any parts or combination thereof. In other words the air-guide 60 is a functional element that may nevertheless be integrated as a part of the cyclone chamber 10 or, in another preferred and cost-effective embodiment, comprise a bulge in the cyclone chamber wall 11.

FIG. 6 also provides a perspective view of a preferred embodiment of the vacuum cleaner according to the invention. Exemplarily the air-guide 60 is integrally formed as one piece with the dirt-duct 40. The air-guide 60 preferentially features rounded edges that may counteract the accumulation of dust. For the same reason the top 63 and bottom 64 of the air-guide 60 are preferentially closed surfaces. The height of the air-guide 60 is equal to or larger than the last exit ridge 42. Height in this context refers the length of said air-guide 60 or exit ridge 42 in direction of a central axis of the cyclone chamber. Said height is in the range from 10 to 150 mm, advantageously from 10 to 80 mm, in particular from 25 to 55 mm, preferably 40 mm in this particular embodiment. Alternatively the ratio of said height to the height of the cyclone chamber 10 is less or equal to 1, in particular less or equal to ½, preferably ⅓.

In a practical implementation, the cyclone chamber 10 can have an inner diameter which is smaller than 150 mm. In fact, it is preferred to have a diameter which is as small as possible, but the value of the diameter has a practical minimum on the basis of the fact that it is desirable to have an option of removal by hand of items which are so large that stoppage occurs.

In further embodiments of the invention the air-guide 60 may extend longer along the side wall 11 of the cyclone chamber 10 and or protrude deeper into the cyclone chamber 10. In a further embodiment, the air-guide surface 65 facing towards the inner of the cyclone chamber is similar to a wing profile known form aeronautics. Preferentially the air-guide 60 is a rounded shape that does not have sharp edges and/or acute angles.

In summary, the present invention provides for a reduction of noise while maintaining the dirt separation performance in cyclone vacuum cleaners and cyclone separation devices. This is achieved by an arrangement comprising a cyclone chamber, a dirt collecting chamber arranged adjacent to the cyclone chamber for collecting dirt particles separated from air, a dirt-duct between the cyclone chamber and the dirt collecting chamber for allowing dirt particles to pass from the cyclone chamber towards the dirt collecting chamber, and an air-guide arranged adjacent to the dirt-duct for reducing the momentum of the air in the dirt-duct.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A vacuum cleaner, comprising:

a cylindrical cyclone chamber having a circumferential side wall;

a dirt collecting chamber arranged adjacent to the cylindrical cyclone chamber for collecting dirt particles separated from air;

a dirt-duct coupled between the cylindrical cyclone chamber and the dirt collecting chamber for allowing dirt particles to pass from the cylindrical cyclone chamber towards the dirt collecting chamber; and an air-guide coupled within the cylindrical cyclone chamber to an inner wall portion of said circumferential side wall and arranged within the cylindrical cyclone chamber, the air-guide having a front side thereof adjacent to an inlet of the dirt-duct and a rear end thereof that is distal from the inlet, for reducing a momentum of the air in the dirt-duct, wherein the air-guide further comprises (i) an inner wall portion, having a rounded cross-sectional shape similar to an aeronautics wing profile, projecting into the cylindrical cyclone chamber between the front side and the rear end and (ii) an outer wall portion in direct engagement with the inner wall portion of the circumferential side wall of the cylindrical cyclone chamber extending between the front side and the rear end.

2. The vacuum cleaner as claimed in claim 1, wherein said air-guide protrudes into the cylindrical cyclone chamber.

3. The vacuum cleaner as claimed in claim 1, wherein the front side of said air-guide arranged adjacent to the inlet of the dirt-duct further comprises being arranged at a dirt-duct ridge in a downstream direction of a spiral air stream in the cylindrical cyclone chamber.

4. The vacuum cleaner as claimed in claim 1, wherein a length of said air-guide in a direction of a central axis of the cylindrical cyclone chamber, is larger than or equal to a length of the dirt-duct in a direction of the central axis of the cyclone chamber.

5. The vacuum cleaner as claimed in claim 4, wherein said length of said air-guide in a direction of the central axis of the cylindrical cyclone chamber comprises a length selected from the group consisting of (i) a range from 10 to 150 mm, (ii) a range from 10 to 80 mm, (iii) a range from 25 to 55 mm, and (iv) 40 mm.

6. The vacuum cleaner as claimed in claim 4, wherein a ratio of said length of said air-guide in a direction of the central axis of the cylindrical cyclone chamber to a length of said cylindrical cyclone chamber in a direction of the central axis of the cylindrical cyclone chamber comprises a ratio selected from the group consisting of (i) less than or equal to 1, (ii) less than or equal to ½, and (iii) ⅓.

7. The vacuum cleaner as claimed in claim 1, wherein a surface of the air-guide facing a center of the cylindrical cyclone chamber has a curvature opposite to a curvature of the circumferential side wall at a same location of the circumferential side wall where the air-guide is coupled thereto.

8. The vacuum cleaner as claimed in claim 7, wherein a radius of curvature of the air guide comprises a radius of curvature selected from the group consisting of (i) a range from 15 to 70 mm, (ii) a range from 20 to 40 mm, and (iii) 30 mm.

9. The vacuum cleaner as claimed in claim 1, wherein the dirt-duct and the air-guide are integrally formed as one piece.

10. The vacuum cleaner as claimed in claim 1, wherein the air-guide has rounded edges.

11. The vacuum cleaner as claimed in claim 1, wherein at least one of a top surface and a bottom surface of said air-guide is a closed surface.

12. A cyclone separation device, comprising;

a cylindrical cyclone chamber having a circumferential side wall;

a dirt-duct coupled to the cylindrical cyclone chamber for allowing dirt particles to exit the cylindrical cyclone chamber; and an air-guide coupled within the cylindrical cyclone chamber to an inner wall portion of said circumferential side wall and arranged within the cylindrical cyclone chamber, the air-guide having a front side thereof adjacent to an inlet of the dirt-duct and a rear end thereof that is distal from the inlet, for reducing a momentum of the air in the dirt-duct, wherein the air-guide further comprises (i) an inner wall portion, having a rounded cross-sectional shape similar to an aeronautics wing profile, projecting into the cylindrical cyclone chamber between the front side and the rear end and (ii) an outer wall portion in direct engagement with the inner wall portion of the circumferential side wall of the cylindrical cyclone chamber extending between the front side and the rear end.

13. A vacuum cleaner, comprising:

a cylindrical cyclone chamber having a circumferential side wall;

a dirt collecting chamber arranged adjacent to the cylindrical cyclone chamber for collecting dirt particles separated from air;

a dirt-duct coupled between the cylindrical cyclone chamber and the dirt collecting chamber for allowing dirt particles to pass from the cylindrical cyclone chamber towards the dirt collecting chamber; and an air-guide coupled within the cylindrical cyclone chamber to an inner wall portion of said circumferential side wall and arranged within the cylindrical cyclone chamber, the air-guide having a front side thereof adjacent to an inlet of the dirt-duct and a rear end thereof that is distal from the inlet, for reducing a momentum of the air in the dirt-duct, wherein the air-guide further comprises (i) an inner wall portion, having a rounded cross-sectional shape similar to an aeronautics wing profile, projecting into the cylindrical cyclone chamber between the front side and the rear end and (ii) an outer wall portion in direct engagement with the inner wall portion of the circumferential side wall of the cylindrical cyclone chamber extending between the front side and the rear end, and wherein a surface of the air-guide facing a center of the cylindrical cyclone chamber has a curvature opposite to a curvature of the circumferential side wall at a same location of the circumferential side wall where the air-guide is coupled thereto.

14. A cyclone separation device, comprising:

a cylindrical cyclone chamber having a circumferential side wall;

a dirt-duct for allowing dirt particles to exit the cylindrical cyclone chamber; and an air-guide coupled within the cylindrical cyclone chamber to an inner wall portion of the circumferential side wall and arranged within the cylindrical cyclone chamber, the air-guide having a front side thereof adjacent to an inlet of the dirt-duct and a rear end thereof that is distal from the inlet, for reducing a momentum of the air in the dirt-duct, wherein the air-guide further comprises (i) an inner wall portion, having a rounded cross-sectional shape similar to an aeronautics wing profile, projecting into the cylindrical cyclone chamber between the front side and the rear end and (ii) an outer wall portion in direct engagement with the inner wall portion of the circumferential side wall of the cylindrical cyclone chamber extending between the front side and the rear end, and wherein a surface of the air-guide facing a center of the cylindrical cyclone chamber has a curvature opposite to a curvature of the circumferential side wall at a same location of the circumferential side wall where the air-guide is coupled thereto.

* * * * *